United States Patent [19]

Bible

[11] 3,963,042

[45] June 15, 1976

[54] INTERNAL COMBUSTION ENGINE CONTROL SYSTEM AND IMPROVED PNEUMATICALLY OPERATED TEMPERATURE CONTROLLED VALVE CONSTRUCTION THEREFOR OR THE LIKE

[75] Inventor: Harley V. Bible, Maryville, Tenn.

[73] Assignee: Robertshaw Controls Company, Richmond, Va.

[22] Filed: Aug. 21, 1974

[21] Appl. No.: 499,176

[52] U.S. Cl. ..... 137/468; 123/117 A

[51] Int. Cl.[2] ..... F02P 5/04

[58] Field of Search ..... 123/117 A, 119 A; 137/468, 479; 236/101

[56] References Cited

UNITED STATES PATENTS

| | | | |
|---|---|---|---|
| 2,895,500 | 7/1959 | Barnett | 137/468 |
| 3,157,168 | 11/1964 | Sterner et al. | 123/117 A |
| 3,332,436 | 7/1967 | Welty | 137/468 |
| 3,385,275 | 5/1968 | Burnia et al. | 123/117 A |
| 3,494,338 | 2/1970 | Reise | 123/117 A |
| 3,503,377 | 3/1970 | Beatenbough et al. | 123/117 A |
| 3,612,018 | 10/1971 | Soberski | 123/117 A |
| 3,704,697 | 12/1972 | Weymann | 123/117 A |
| 3,729,132 | 4/1973 | Ludwig | 123/117 A X |
| 3,857,373 | 12/1974 | Martin et al. | 123/117 A |

*Primary Examiner*—Charles J. Myhre
*Assistant Examiner*—Ira S. Lazarus
*Attorney, Agent, or Firm*—Candor, Candor & Tassone

[57] ABSTRACT

An internal combustion engine control system having a source of vacuum and a vacuum operated control device. A vacuum operated temperature controlled valve construction is provided for interconnecting the source to the device when the construction senses a certain temperature, the construction having means for only disconnecting the source from the device when the value of the source falls below a certain level thereof regardless of the temperature being sensed. The valve construction has a temperature operated pilot valve arrangement for actuating the valve construction to an open condition thereof when the certain temperature is sensed, the pilot valve arrangement including a snap acting bimetal disc for opening and closing a pilot valve seat thereof.

10 Claims, 5 Drawing Figures

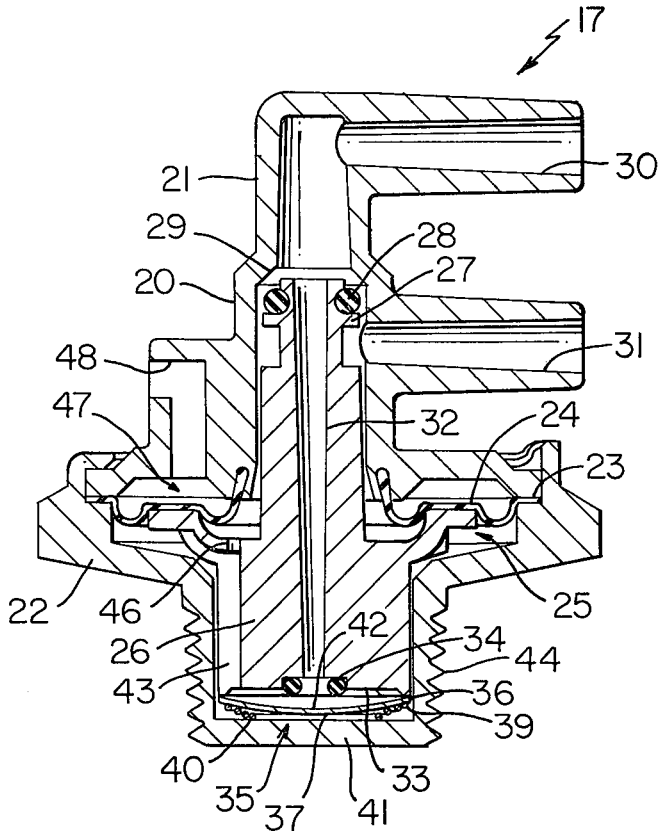
FIG.4
FIG. 5
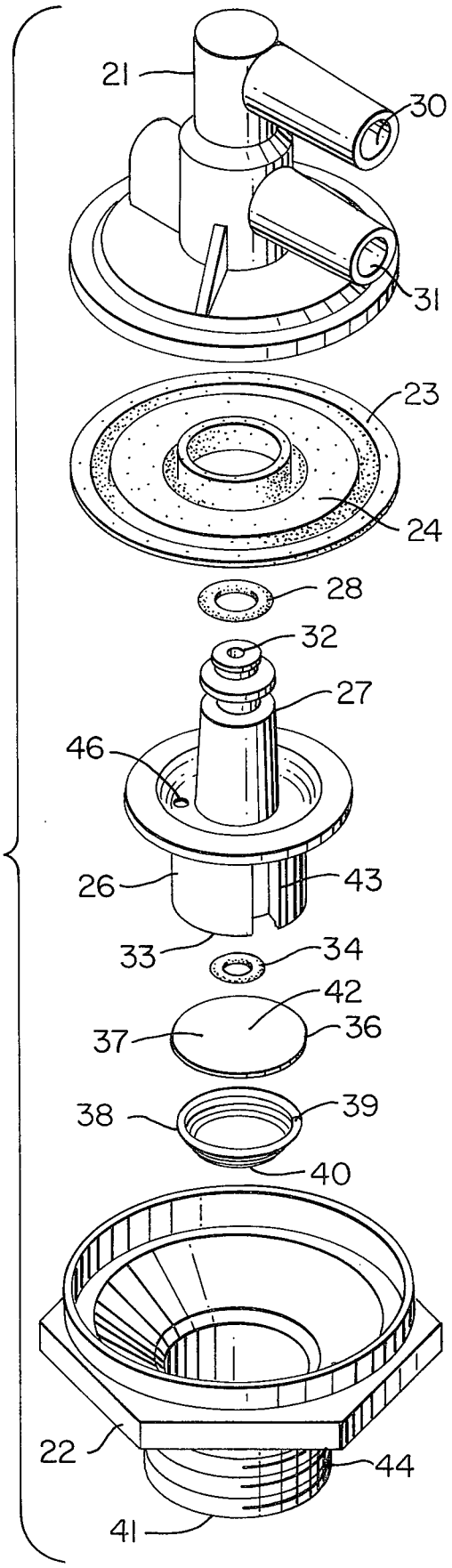

INTERNAL COMBUSTION ENGINE CONTROL SYSTEM AND IMPROVED PNEUMATICALLY OPERATED TEMPERATURE CONTROLLED VALVE CONSTRUCTION THEREFOR OR THE LIKE

This invention relates to an improved internal combustion engine control system as well as to an improved pneumatically operated temperature controlled valve construction useable with such system or the like.

It is well known that pollution control systems are being provided for internal combustion engines wherein operating parts are to be controlled after the temperature of the engine or other device controlled thereby reaches a certain temperature and such device is to be continued to be operated until the engine is subsequently turned off.

Accordingly, it is a feature of this invention to provide a pneumatically operated temperature controlled valve construction for controlling such an engine control device or the like.

In particular, one embodiment of this invention provides an internal combustion engine control system that has a source of vacuum and a vacuum operated control device. The pneumatically operated temperature controlled valve construction of this invention is adapted for interconnecting the source to the device when the construction senses a certain temperature whereby the vacuum operated control device will be turned to an "on" condition thereof once the output temperature effect of the engine reaches that certain temperature. The valve construction has means for only disconnecting the source from the control device when the value of the source falls below a certain level thereof regardless of the temperature being sensed. The valve construction has a temperature operated pilot valve means for actuating the valve construction to an open condition thereof to interconnect the source to the control device when the certain temperature is sensed, the pilot valve means including a bimetal snap disc for opening and closing a pilot valve seat in relation to the temperature being sensed by the bimetal disc.

Accordingly, it is an object of this invention to provide an improved internal combustion engine control system having one or more of the novel features set forth above or hereinafter shown or described.

Another object of this invention is to provide an improved pneumatically operated temperature controlled valve construction having one or more of the novel features set forth above or hereinafter shown or described.

Other objects, uses and advantages of this invention are apparent from a reading of this description which proceeds with reference to the accompanying drawings forming a part thereof and wherein:

FIG. 4 is a view similar to FIG. 2 and illustrates the valve construction in an open condition thereof.

FIG. 5 is an exploded perspective view of the various parts of the pneumatically operated temperature controlled valve construction of FIGS. 2–4.

Figure 1:
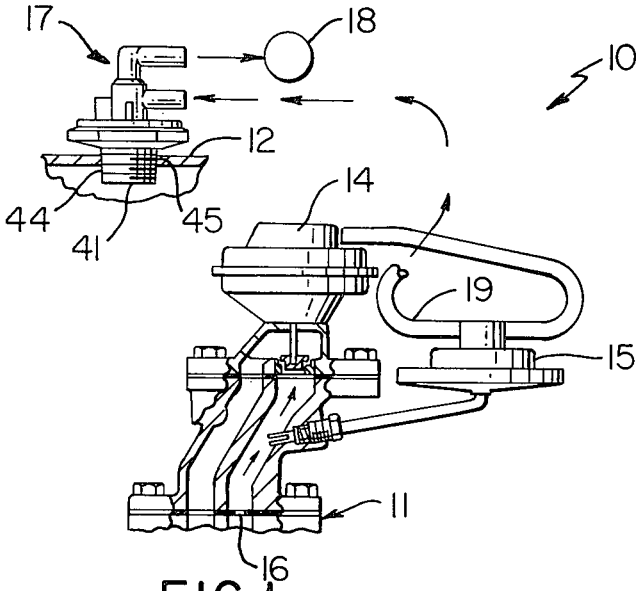
FIG. 1 is a schematic view illustrating the improved internal combustion engine control system of this invention.

While the various features of this invention are hereinafter described and illustrated as being particularly adapted to provide a vacuum operated temperature controlled valve construction for an internal combustion engine control system, it is to be understood that the various features of this invention can be utilized singly or in any combination thereof to provide a pneumatically operated temperature controlled valve construction for other uses as desired.

Therefore, this invention is not to be limited to only the embodiment illustrated in the drawings, because the drawings are merely utilized to illustrate one of the wide variety of uses of this invention.

Referring now to FIG. 1, the improved internal combustion engine control system of this invention is generally indicated by the reference numeral 10 and comprises an internal combustion engine 11 having a conventional water jacket 12 therefor and through which a suitable engine cooling fluid is circulated and is thereby heated during the operation of the engine 11. A vacuum operated control device 14 is provided for the engine 11 to provide a pollution control function therefor. However the device 14 is not to be operated until the temperature of the fluid in the water jacket 12 reaches a certain temperature, such as normally occurs a short period of time after the engine 11 has been initially operated for a certain period of use thereof.

For example, the vacuum operated control device 14 can comprise an exhaust-pressure modulated valve to help control the oxides of nitrogen produced by the internal combustion engine 11. In this manner, the vacuum operated device 14 is adapted to be proportioned to engine load by an exhaust back pressure signal being directed to the vacuum operated control valve 14 by a transducer valve 15 whereby the transducer valve 15 seeks to maintain a constant control pressure between the control valve 14 and a control orifice 16 in the engine 11. In this manner, the vacuum operated control valve 14 has the flow thereof become a function of the size of the control orifice 16 and the back pressure of the engine 11. However, the details of the operation of the pollution control device 14 does not form a part of this invention as the device 14 is to function in any desired manner when the same receives a vacuum signal as will be apparent hereinafter.

Figure 2:
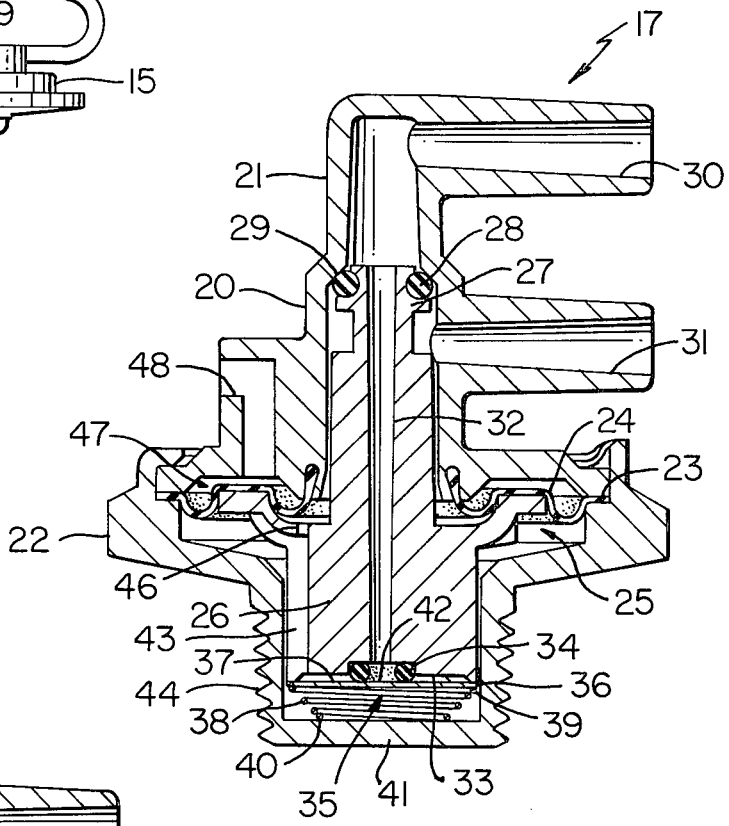
FIG. 2 is an enlarged cross-sectional view of the improved pneumatically operated temperature controlled valve construction of this invention with the same being illustrated in its closed condition.
Figure 3:
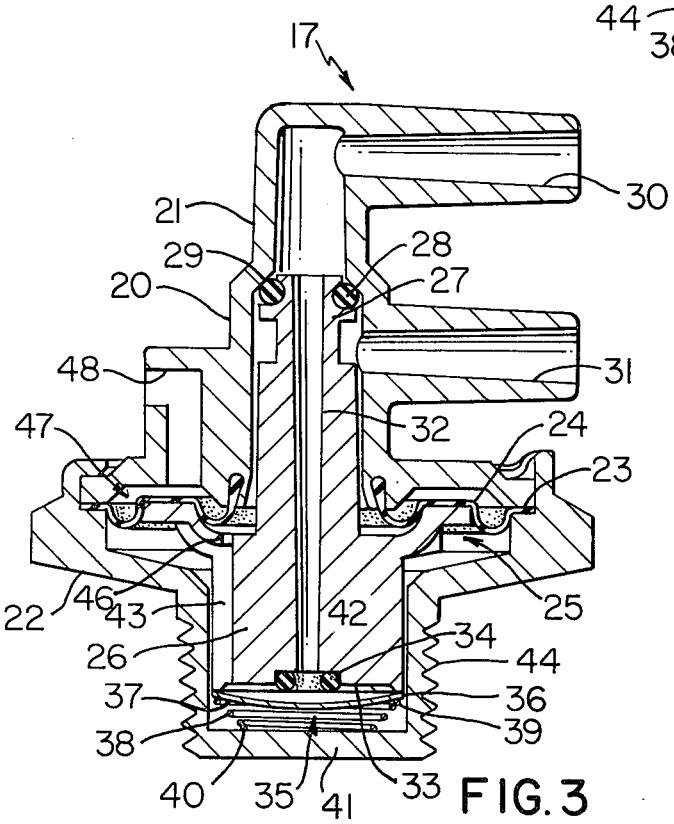
FIG. 3 is a view similar to FIG. 2 and illustrates the pilot valve means in an open condition thereof.

As previously stated, a vacuum operated temperature controlled valve construction of this invention is provided for the control system 10 and is generally indicated by the reference numeral 17 in FIGS. 1 and 2. The valve construction 17 is adapted to interconnect the vacuum source 18 of the engine 11 to the transducer valve 15 and, thus, to the vacuum operated control device 14 through a conduit means 19 when the valve construction 17 is disposed in an open condition as illustrated in FIG. 4 in a manner hereinafter described and to disconnect the vacuum source 18 from the control device 14 when the value of the vacuum source 18 falls below a certain value, such as which happens when the engine 11 is turned off after a normal run thereof.

As illustrated in FIGS. 2–5, the valve construction 17 of this invention comprises a housing means 20 formed from a plurality of housing parts 21 and 22 suitably secured together and trapping the outer peripheral portion 23 of a flexible diaphragm 24 therebetween whereby the diaphragm 24 cooperates with the housing member 22 to define a chamber 25 therein.

The flexible diaphragm 24 carries a movable valve member 26 that is adapted to move in unison with the diaphragm 24, the movable valve member 26 being a stem member having an end 27 provided with a resilient O-ring type seal 28 for opening and closing against a frusto-conical valve seat surface 29 of the housing part 21. The valve seat 29 separates an inlet port 30 of the housing means 20 from an outlet port 31 thereof.

The inlet port 30 is adapted to be interconnected to the vacuum source 18 by suitable conduit means while the outlet port 31 is adapted to be interconnected to the conduit means 19 previously described for the system 10 for the purpose previously described and hereinafter set forth.

Thus, when the valve member 26 is disposed in its closed position against the valve seat 29, the valve seat 29 prevents interconnection of the vacuum source 18 to the conduit 19 and, thus, to the control device 14. However, when the valve stem 26 is moved to the open condition illustrated in FIG. 4 in a manner hereinafter described, the vacuum source 18 is adapted to be interconnected to the control device 14 to operate the control device 14 for the purpose previously described.

The valve member 26 has a passage 32 passing completely therethrough from the end 27 thereof to the other end 33 thereof whereby the passage 32 is always in communication with the inlet 30 regardless of whether or not the valve member 26 is closing the valve seat 29 so that the vacuum source 18 is adapted to be interconnected by the passage 32 to a resilient valve seat 34 at the end 33 of the valve member 26, the valve seat 34 comprising part of a pilot valve arrangement for the valve construction 17 that is generally indicated by the reference numeral 35 in the drawings.

The end 33 of the valve member 26 is so shaped that the same is adapted to accommodate the outer peripheral portion 36 of a bimetal snap disc 37 that is normally held against the end 33 of the valve member 26 by a compression spring 38 disposed in the chamber 25 and having one end 39 bearing against the snap disc 37 and the other end 40 thereof bearing against an end wall 41 of the housing part 22 as illustrated in FIG. 2, the force of the compression spring 38 always tending to move the diaphragm 24 and valve member 26 to its valve seat closing position.

The bimetal member 37 is so constructed and arranged that the same when sensing a certain temperature or temperature below that certain temperature is in the unbowed condition illustrated in FIG. 2 so that a central portion 42 thereof is normally urged and disposed in sealing engagement against the valve seat 34 to thereby prevent communication of the passage 32 with the chamber 25 of the valve construction 17. However, when the bimetal member 37 senses that certain temperature or a temperature above that certain temperature, the same snaps to the bowed condition illustrated in FIGS. 3 and 4 to open the valve seat 34 so that the valve seat 34 will be interconnected to the chamber 25 through the opened valve seat 34 and a slot construction 43 formed in the side of the valve stem 26. In this manner, the vacuum source 18 can now be interconnected to the chamber 25 to evacuate the same whereby the resulting pressure differential now acting across the diaphragm 24 moves the diaphragm 24 and valve member 26 downwardly as illustrated in FIG. 4 in opposition to the force of the spring 38 to thereby open the main valve seat 29 as illustrated and thus interconnect the vacuum source 18 to the vacuum operated control device 14.

The chamber 25 is interconnected to the valve seat 29 by a passage or opening 46 in the valve member 26 for a purpose hereinafter described and a chamber 47 defined between the diaphragm 24 and the housing part 21 is interconnected to the atmosphere by a passage 48 to prevent a dash pot effect that might retard movement of the diaphragm 24 as will be apparent hereinafter.

The housing part 22 has an externally threaded portion 44 that carries the bimetal member 37 therein with the threaded portion 44 being adapted to be threadedly disposed in a threaded opening 45 of the water jacket 12 as illustrated in FIG. 1 whereby the bimetal member 37 is, in effect, immersed in the fluid of the jacket 12 to acurately sense the temperature thereof so that the control system 10 and valve construction 17 can operate in a manner now to be described.

Assuming that the engine 11 is in an "off" condition thereof, no vacuum is being created at the source 18 by the engine 11 and the temperature of the fluid in the jacket 12 is below a certain operating temperature thereof whereby the valve construction 17 is normally disposed in the position illustrated in FIG. 2 whereby the force of the compression spring 38 maintains the valve member 26 in its closed position against the valve seat 29 and the bimetallic disc 37 is closing the pilot valve seat 34 as illustrated in FIG. 2. Thus, the source 18 is not interconnected to the control device 14 and the device 14 is in its non-activated condition.

When the engine 11 is initially started, even though the vacuum source 18 is now being created by the engine 11, such as at the manifold thereof, the source 18 is still prevented from being interconnected to the control device 14 to operate the same as the valve member 26 remains seated against the main valve seat 29 in the manner illustrated in FIG. 2 as the temperature of the fluid in the jacket 12 is not at a temperature to cause the bimetal member 37 to snap open. However, when the temperature of the fluid in the jacket 12 subsequently reaches that certain temperature as the engine continues to operate, the bimetal member 37 senses such temperature and snaps open from the position illustrated in FIG. 2 to the position illustrated in FIG. 3 whereby it can be seen that the vacuum source 18 is now interconnected through the passage 32, open valve seat 34 and passage 43 of the valve member 26 to the chamber 25 so that the resulting pressure differential now acting across the flexible diaphragm 24 is sufficient to pull the flexible diaphragm 24 downwardly and carry the valve member 26 therewith in opposition to the force of the compression spring 38 to open the valve seat 29 in the manner illustrated in FIG. 4.

In this manner, the vacuum source 18 is now interconnected to the conduit 19 and, through the transducer valve 15 to the control device 14 to operate the same for pollution control purposes as previously described.

The valve member 26 remains in the open condition illustrated in FIG. 4 as long as the engine 11 continues to operate whereby the value of the vacuum source 18 is maintained above a certain value by the operating engine 11.

However, should the temperature of the fluid in the jacket 12 fall below the certain temperature while the engine 11 is still operating, the valve member 26 will still remain in the open condition even though the bimetal member 37 will snap back to the closed position illustrated in FIG. 2 to close off the seat 34 because the vacuum now maintained in chamber 25 holds the diaphragm 24 and valve member 26 in the open position illustrated in FIG. 4 in opposition to the force of the compression spring 38 as the chamber 25 is still interconnected to the vacuum source 18 through the opening 46 in the valve member 26 and the open valve seat 29. In this manner, the vacuum condition in the chamber 25 is maintained to hold the diaphragm 24 in its valve opening position even though the pilot valve seat 34 is now closed under this condition.

Thus, the valve member 26 remains in its open condition until the value of the vacuum source 18 falls below a certain level thereof, such as when the engine 11 is turned off, so that a loss of vacuum in the chamber 25 takes place and the force of the compression spring 38 is now sufficient to move the valve member 26 and diaphragm 24 upwardly to close against the valve seat 29 in the manner illustrated in FIG. 2 to thereby close off the vacuum source 18 from the control device 14. Thus, the control device 14 is not again interconnected to the vacuum source 18 until the fluid in the jacket 12 reaches the previously described certain temperature after the engine 11 is again turned on for another run thereof.

Accordingly, it can be seen that since the bimetal disc 37 only opens and closes the pilot valve seat 34, the flow capacity through the pilot valve seat 34 is not a factor in the operation of the bimetal member 37 so that a very small bimetal disc 37 can be utilized. This provides a faster time response than a bimetal disc of a somewhat larger size. Also, it can be seen that the bimetal disc 37 is located in the bottom portion of the threaded part 44 of the valve construction 17 so that the same will be located down inside of the water jacket 12 to insure fast time response thereof to greatly reduce ambient temperature effects on the valve construction 17.

Since the pollution control device 14 is normally mounted on the radiator of the engine 11, the running of the engine 11 in a very cold ambient temperature may cause the fluid in the radiator to drop below the bimetal disc reset temperature even though the engine 11 is still hot. Thus, even though the bimetal member 37 closes against the valve seat 34 during such condition, the valve construction 17 has the advantage that once the main valve seat 29 is opened in the manner previously described, the valve construction 17 will not close the main valve seat 29 at any temperature being sensed by the bimetal member 37 until the engine 11 is turned off or the vacuum source 18 has its value dropped below the minimum operating ranges thereof as previously described.

Therefore, it can be seen that this invention not only provides an improved internal combustion engine control system, but also this invention provides an improved pneumatically operated temperature controlled valve construction for such a system or the like.

While the form of the invention now preferred has been illustrated and described as required by the Patent Statute, it is to be understood that other forms can be utilized and still come within the scope of the appended claims.

What is claimed is:

1. A pneumatically operated temperature controlled valve construction adapted for initially interconnecting a pneumatic source to a pneumatically operated device only when said construction senses a certain temperature, said construction having means for thereafter only disconnecting said source from said device when the value of said source falls below a certain level thereof regardless of sensed temperature, said construction having temperature operated pilot valve means adapted for actuating the same to an open condition thereof when said certain temperature is sensed.

2. A pneumatically operated temperature controlled valve construction as set forth in claim 1 wherein said pilot valve means has a bimetal member adapted for interconnecting said pneumatic source to said valve construction to open the same when said bimetal member senses said certain condition.

3. A pneumatically operated temperature controlled valve construction as set forth in claim 2 wherein said bimetal member comprises a snap disc.

4. A pneumatically operated temperature controlled valve construction as set forth in claim 3 wherein said pilot valve means has a valve seat through which said source is adapted to be interconnected to said valve construction to open the same, said bimetal snap disc having a central portion thereof cooperable with said valve seat to open and close the same.

5. A pneumatically operated temperature controlled valve construction as set forth in claim 4 wherein said valve construction has a threaded bulb portion containing said bimetal snap disc.

6. A pneumatically operated temperature controlled valve construction as set forth in claim 1 wherein said valve construction has a main valve seat through which said source is adapted to be interconnected to said device, said valve construction having a movable valve member for opening and closing said main valve seat, said movable valve member being pneumatically operated.

7. A pneumatically operated temperature controlled valve construction as set forth in claim 6 wherein said movable valve member includes a flexible diaphragm to be moved by pressure differential acting across the same.

8. A pneumatically operated temperature controlled valve construction as set forth in claim 7 wherein said movable valve member includes a valve stem carried by said flexible diaphragm and having an end for opening and closing said main valve seat.

9. A pneumatically operated temperature controlled valve construction as set forth in claim 8 wherein said valve stem has a passage therethrough leading to a pilot valve seat through which said pneumatic source is adapted to be interconnected to said diaphragm to operate the same, said pilot valve means comprising a temperature responsive valve member for opening and closing said pilot valve seat.

10. A pneumatically operated temperature controlled valve construction as set forth in claim 9 wherein said temperature responsive valve member comprises a bimetal snap disc.

* * * * *